US010369619B2

(12) United States Patent
Di Serio et al.

(10) Patent No.: US 10,369,619 B2
(45) Date of Patent: Aug. 6, 2019

(54) METHOD OF DRESSING A FORGE DIE IN THE IMPLEMENTATION OF PARTS OBTAINED BY TWO SUCCESSIVE OPERATIONS OF FOUNDRY CASTING FOLLOWED BY FORGING

(71) Applicant: SAINT JEAN INDUSTRIES, Saint Jean d'Ardieres (FR)

(72) Inventors: Emile Di Serio, Chenas (FR); Fabien Soubras, Belleville sur Saone (FR)

(73) Assignee: SAINT JEAN INDUSTRIES, Saint Jean d'Ardieres (FR)

( * ) Notice: Subject to any disclaimer, the term of this patent is extended or adjusted under 35 U.S.C. 154(b) by 1155 days.

(21) Appl. No.: 14/369,371

(22) PCT Filed: Dec. 5, 2012

(86) PCT No.: PCT/FR2012/052804
§ 371 (c)(1),
(2) Date: Jun. 27, 2014

(87) PCT Pub. No.: WO2013/098501
PCT Pub. Date: Jul. 4, 2013

(65) Prior Publication Data

US 2014/0373592 A1 Dec. 25, 2014

(30) Foreign Application Priority Data

Dec. 29, 2011 (FR) ..... 11 62512

(51) Int. Cl.
*B05B 5/00* (2006.01)
*B21J 1/06* (2006.01)
(Continued)

(52) U.S. Cl.
CPC *B21J 3/00* (2013.01); *B05B 5/00* (2013.01); *B21J 1/06* (2013.01); *B21J 5/002* (2013.01); *B22C 9/12* (2013.01)

(58) Field of Classification Search
CPC ..... B21J 3/00; B21J 5/002
See application file for complete search history.

(56) References Cited

U.S. PATENT DOCUMENTS 3,556,255 A * 1/1971 Lomax, Jr. ..... B21J 3/00 118/62
3,931,020 A * 1/1976 Burgess ..... C10M 173/02 508/129

(Continued)

FOREIGN PATENT DOCUMENTS

EP 0 119 365 A1 9/1984
EP 0 955 113 A1 11/1999

(Continued)

*Primary Examiner* — Gregory D Swiatocha
(74) *Attorney, Agent, or Firm* — Seed IP Law Group LLP

(57) ABSTRACT

A method includes creating, in a foundry, a preform to the desired shape and size, in transferring this preform from the foundry to a tunnel oven, then preheating it to a temperature of around 500° C., transferring the preheated foundry preform into a die forge with a substantially smaller size and shape, and performing the die punching operation at a pressure of between 600 and 700 MPA, before the transfer of the preheated foundry preform to the forge die, the forge die and pins for positioning the preform are put through a powder-spraying operation on the entire inner surface of the forge die which is liable to receive the preheated foundry preform and the pins.

8 Claims, 1 Drawing Sheet

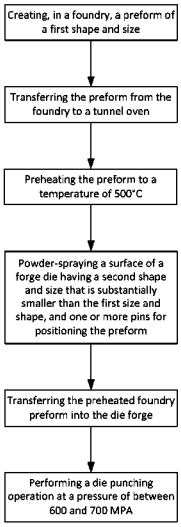

(51) Int. Cl.

| | |
|---|---|
| ***B21J 3/00*** | (2006.01) |
| ***B21J 5/00*** | (2006.01) |
| ***B22C 9/12*** | (2006.01) |

(56) References Cited

U.S. PATENT DOCUMENTS

| | | | | |
|---|---|---|---|---|
| 3,962,103 | A * | 6/1976 | Johnston | C10M 7/00 508/122 |
| 5,468,401 | A * | 11/1995 | Lum | C10M 111/02 508/115 |
| 5,582,659 | A * | 12/1996 | Hashimoto | B22D 21/007 148/439 |
| 6,330,818 | B1 * | 12/2001 | Jain | B21J 3/00 72/42 |
| 6,432,886 | B1 * | 8/2002 | Reidmeyer | B22D 17/2038 106/38.22 |
| 7,895,875 | B2 * | 3/2011 | Dickson | B21C 5/00 72/370.02 |
| 2002/0170635 | A1 * | 11/2002 | DiSerio | B21J 5/00 148/552 |
| 2010/0254850 | A1 * | 10/2010 | Pandey | B22F 3/17 420/529 |

FOREIGN PATENT DOCUMENTS

| | | |
|---|---|---|
| EP | 1 186 361 A1 | 3/2002 |
| EP | 1 219 367 A1 | 7/2002 |
| FR | 2 803 232 A1 | 7/2001 |

* cited by examiner

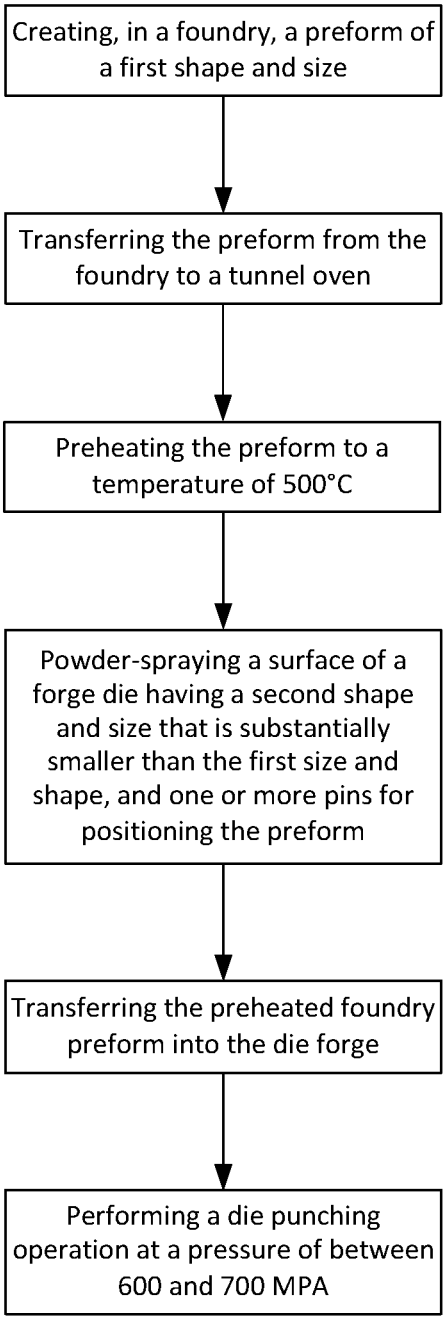
Creating, in a foundry, a preform of a first shape and size
Transferring the preform from the foundry to a tunnel oven
Preheating the preform to a temperature of 500°C
Powder-spraying a surface of a forge die having a second shape and size that is substantially smaller than the first size and shape, and one or more pins for positioning the preform
Transferring the preheated foundry preform into the die forge
Performing a die punching operation at a pressure of between 600 and 700 MPA

METHOD OF DRESSING A FORGE DIE IN THE IMPLEMENTATION OF PARTS OBTAINED BY TWO SUCCESSIVE OPERATIONS OF FOUNDRY CASTING FOLLOWED BY FORGING

BACKGROUND

Technical Field

The invention concerns the production of parts obtained in the technical area involving foundry casting and forging operations, and parts put through successive foundry casting then forging operations.

Description of the Related Art

The latter technology has been developed and described in the patent EP 119 365 utilized by the Applicant, in particular for the treatment of aluminum and/or aluminum alloy parts and light alloy parts.

BRIEF SUMMARY

A method of casting and forging is disclosed. The method may comprise creating, in a foundry, a preform of a first shape and size, transferring the preform from the foundry to a tunnel oven, preheating the preform to a temperature of around 500° C., powder-spraying a surface of the forge die and one or more pins for positioning the preform, transferring the preheated foundry preform into a die forge with a second shape and size that is substantially smaller than the first size and shape, and performing a die punching operation at a pressure of between 600 and 700 MPA.

BRIEF DESCRIPTION OF THE DRAWINGS

FIG. 1 is a flow chart diagram of a method according to at least one illustrated embodiment.

DETAILED DESCRIPTION

Accordingly, this method consists in the foundry casting of aluminum or aluminum alloy parts in a preform then their transfer into a forge die, the cavity of which is slightly smaller than the size of the preform, and performing a die stamping operation to obtain a part whose shape and sizes are chosen with higher mechanical properties.

The Applicant has developed many improvements in the technology, and in particular that of a graphite coating applied after the obtaining of a foundry preform. This technology involving the depositing of a graphite coating was described in detail in the patent FR 2 803 232.

In practice, the preform obtained by foundry casting is submerged in a bath containing a graphite coating then transferred into a tunnel oven at a temperature of around 400 to 500° C. This operation of transfer into the tunnel of the unit is designed in particular to make the preform more malleable for the subsequent forging operation.

The preform coated in this way is then transferred into the forge die for die stamping. The forge die also features prior emulsion type dressing to facilitate the creepage of the material in the running zone and preventing the alloy from adhering to the tools.

This technical solution is widely utilized by the Applicant. On this basis, and in practice, it leads to extra costs at two levels:

First of all, using a graphite coating means controlling the baths and their dilution because the graphite used is diluted in water. This means that control is demanding, requiring the implementation of graphite coating bath correcting and stabilizing means.

Then, it is necessary to use an emulsion to be sprayed onto the material of the forge to cool the die each time, generating thermal shocks which reduces the lifespan of the die.

Confronted by this issue inherent in the operation of this casting-forging technology known under the brand name of 'COBAPRESS' of the Applicant, that is the manufacturing of aluminum or aluminum alloy or a light alloy parts by two successive operations involving the casting of a preform and then its forging, the Applicant was led to think about research into his submission which improves the graphite coating phase or which could replace it.

Therefore, the approach of the Applicant was to investigate the dressing technique generally known as a separate subject in the foundry field to that of forging, which are totally independent of each other as far as it was known to be Applicant.

Briefly, and as a reminder, in foundry work, dressing consists in the application of a protective coating to facilitate the mold release of the part. This method is known in the fields of sand molding, metal molding and gravity foundry. Dressing can be permanent (e.g., metal mold foundry) or can be applied between each casting. Dressing is applied by means of jets or brushes.

In a foundry work, there is also oil dressing by manifold or robot, and dry dressing used in the particular case of pressure foundry.

In the traditional forging area, dressings are also used to help with the creepage of the matter and to prevent the metal from adhering to the dies. Use is also made of graphite oils, aqueous or non-aqueous graphite solutions for spraying or coating, ceramics, and solid lubricants such as dry dressings.

Although in the worlds of foundry and forging, considered separately, the implementation of a dry dressing it is a known technique, the implementation of this method has never been applied to a process liable to combine the two successive operations of foundry casting and then forging. The Applicant himself was at the source of the 'COBAPRESS' method described in patent EP 119 365, and developed the implementation of a graphite coating as mentioned previously in patent FR 2 803 232.

In practice, because of the very nature of this 'COBAPRESS' casting-forging process, it is impossible to use the dressing technique with traditional solutions and the known techniques used for traditional foundry and traditional forging.

The Applicant, who considered this issue for a long time by examining all the cost and implementation spinoffs, discovered a particularly interesting solution as part of a particular selection of the dressing operation and control of the manufacturing costs and operating conditions without them becoming an obstacle because of untenable investment costs.

Phase tests performed confirm the advantage of the solution produced by the Applicant.

Accordingly, according to the invention, the method consists in implementing in a process which consists in the foundry casting of a preform to the desired shape and size, in transferring this preform from the foundry to a tunnel oven, then preheating it to a temperature of around 500° C., transferring the preheated foundry preform into a die forge with a substantially smaller size and shape, and performing the die punching operation at a pressure of between 600 and 700 MPA, with the method characterized in that, before the transfer of the preheated foundry preform to the forge die, the forge die and the means of positioning the preform, consisting of pins, are put through a powder-spraying operation on the entire inner surface of the forge die which is liable to receive the preheated foundry preform and the pins.

According to another characteristic of the invention, spraying it can take place with or without an electrostatic deposit.

An electrostatic depositing ensures consistent depositing and makes it possible to reach areas of the forge die that are inaccessible due to the configuration of the preform. The powder which is projected and pulverized contains a wax used as a vector or for the mold release agents and melting at 100° C. The powder can include a composition based on a graphite particles, or not, in very limited proportions in the case of electrostatic deposit, of around 10% maximum.

The solution offered by the invention brings in many advantages over the technology developed by the Applicant. There is no further need to have the graphite coating retention tank and there is no need for using water any more. There is no longer any need to monitor the dilution factor, considerably reducing the cost of follow-up and maintenance. The environmental noise level is reduced for projecting the liquid dressing onto the die and with respect to the elimination of the coating tanks, there is no further liquid wastage and the suction network involved in projecting the liquid dressing onto the die is no longer subject to fouling.

From the technical standpoint, preform creepage is improved during forging and the soiling of the tools used for forging is decreased while the lifespan of the impact die is increased, being exposed to fewer thermal shocks.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of casting and forging, the method comprising:

creating, in a foundry, a preform of a first shape and size;

transferring the preform from the foundry to a tunnel oven;

preheating the preform to a temperature of 500° C.;

transferring the preheated foundry preform into a die forge with a second shape and size that is substantially smaller than the first size and shape;

performing a die punching operation at a pressure of between 600 and 700 MPA; and prior to transferring the preheated foundry preform to the forge die, powder-spraying a surface of the forge die and one or more pins for positioning the preform.

2. The method according to claim 1, further comprising: spraying the powder by electrostatic depositing.

3. The method according to claim 2, wherein the powder contains particles.

4. The method according to claim 3, wherein the particles are graphite particles.

5. The method according to claim 3 wherein the particles constitute less than 10% of the powder by weight.

6. The method according to claim 4 wherein the particles constitute less than 10% of the powder by weight.

7. The method according to claim 2 wherein the powder contains a wax.

8. The method according to claim 7 wherein the wax melts at 100° C.

* * * * *